United States Patent [19]

D'Amato

[11] 4,293,791

[45] Oct. 6, 1981

[54] COLOR PICTURE TUBE HAVING IMPROVED CORRUGATED APERTURED MASK

[75] Inventor: Ralph J. D'Amato, Lancaster, Pa.

[73] Assignee: RCA Corporation, New York, N.Y.

[21] Appl. No.: 94,464

[22] Filed: Nov. 15, 1979

[51] Int. Cl.[3] ..... H01J 29/07

[52] U.S. Cl. ..... 313/403; 313/408

[58] Field of Search ..... 313/403, 408

[56] References Cited

U.S. PATENT DOCUMENTS

| | | | |
|---|---|---|---|
| 3,731,129 | 5/1973 | Tsuneta et al. | 313/408 |
| 3,766,419 | 10/1973 | Barbin | 313/403 |
| 3,973,159 | 8/1976 | Barten | 313/403 |
| 4,072,876 | 2/1978 | Morrell | 313/403 |
| 4,127,791 | 11/1978 | Van Lent | 313/403 |
| 4,173,729 | 11/1979 | Stone et al. | 313/403 |
| 4,195,248 | 3/1980 | D'Amato et al. | 313/403 |

*Primary Examiner*—Palmer C. Demeo

*Attorney, Agent, or Firm*—Eugene M. Whitacre; Glenn H. Bruestle; Dennis H. Irlbeck

[57] ABSTRACT

The present invention provides an improvement in a corrugated apertured mask type color picture tube. The mask corrugations are substantially parallel and the mask has slit shaped apertures aligned in columns which are parallel to the mask corrugations and perpendicular to a major axis of the mask. The slits in each column are separated by web portions of the mask. The distance between the centers of two consecutive webs is defined as the web repeat distance. The slits form an aperture array wherein the lengthwise dimension of the slit columns vary with location on the mask. The tube also includes an electron gun for generating a plurality of electron beams and means for scanning the beams in lines across the mask. The improvement comprises making the web repeat distance within a slit column proportional to the distance from the major axis of the mask to the mask intercept of any particular scan line.

4 Claims, 5 Drawing Figures

COLOR PICTURE TUBE HAVING IMPROVED CORRUGATED APERTURED MASK

BACKGROUND OF THE INVENTION

This invention relates to shadow mask type color picture tubes, and particularly to variations in the aperture patterns of shadow masks within such tubes having corrugated apertured masks.

In a recently suggested shadow mask type color picture tube disclosed in U.S. Pat. No. 4,072,876, issued to A. M. Morrell on Feb. 7, 1978, a mask corrugated in the horizontal direction is incorporated in combination with a flat or substantially flat faceplate. The apertures of the corrugated mask are slit-shaped and are aligned in vertical columns. Within the columns, the apertures are separated by bridges in the mask either called tie-bars or webs.

The vertical spacing from the center of one web to the center of the next web within a column is the web repeat distance. To date, all commercial conventional tubes, that is tubes having a spherically curved faceplate and mask, have maintained a constant web repeat distance throughout the mask. Two patents, U.S. Pat. No. 3,766,419 issued to R. L. Barbin on Oct. 16, 1973 and U.S. Pat. No. 4,127,791 issued to J. G. van Lent on Nov. 28, 1979 have suggested that the web repeat distance in a conventional type tube could be varied in some manner over a mask. In the Barbin patent, the web repeat distance is permitted to vary randomly to prevent the formation of a moiré pattern during tube operation. Moiré is an undesirable woodgrain pattern appearing on the screen of a shadow mask color picture tube that is related to the interrelation of scan line spacing and web location. In the van Lent patent, the web repeat distance is varied according to a specific equation to eliminate the formation of irregularly shaped phosphor lines.

It has been found that if a tube, as suggested by the Morrell patent, is constructed with a mask having a uniform web repeat distance throughout, a moiré pattern will form during tube operation. If the teaching of the Barbin patent were applied to such tube, it has been found that although moiré is eliminated, the random pattern is visually objectionable. The teaching of the van Lent patent is inapplicable since it solves a problem associated with spherical masks which does not occur in the corrugated mask suggested by Morrell and the disclosed equations would not prevent moiré in a corrugated mask tube.

Therefore, a need exists for a slit pattern on a corrugated mask which will eliminate or at least minimize the formation of a moiré pattern in an operating tube.

SUMMARY OF THE INVENTION

In a corrugated apertured mask type color picture tube, the web repeat distance with a slit column is made proportional to the distance from the major axis of the mask to the mask intercept of any particular scan line.

DESCRIPTION OF THE PREFERRED EMBODIMENT

Figure 1:
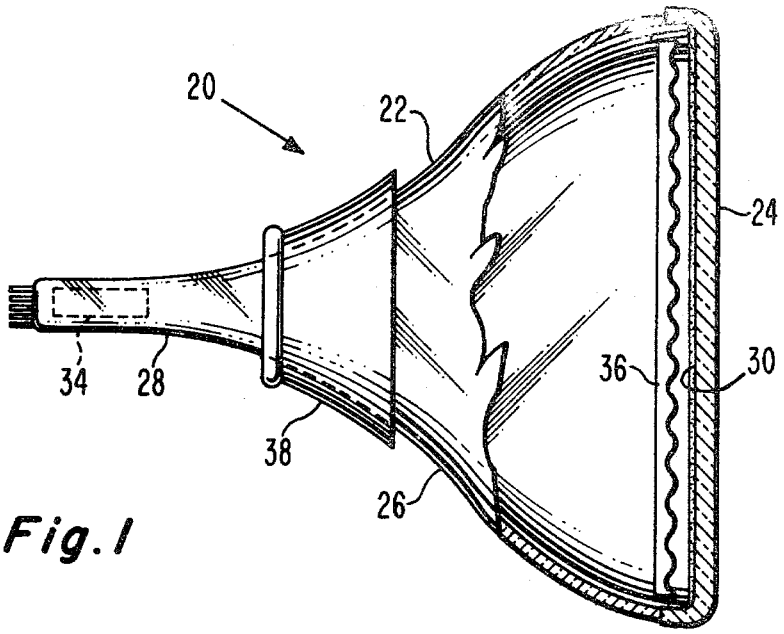
FIG. 1 is a partially cut-away top view of a color picture tube having a flat faceplate and a corrugated mask.

FIG. 1 illustrates an apertured-mask color television picture tube 20 comprising an evacuated glass envelope 22 including a substantially rectangularly-shaped flat faceplate panel 24, a funnel 26, and a neck 28. A three-color mosaic line phosphor-viewing screen 30 is supported on the inner surface of the faceplate panel 24. An electron gun assembly 34, positioned in the neck 28, produces three electron beams (not shown), one for each of the three color phosphors on the viewing screen 30. A rectangular corrugated apertured mask 36 is positioned on the envelope 22 adjacent the viewing screen 30. The electron gun assembly 34 is adapted to project electrons from its three electron beams through the apertured mask 36 to strike the viewing screen structure 30 with the mask 36 serving as a color selection electrode. A magnetic deflection yoke 38 is positioned on the envelope 22 near the intersection of the funnel 26 and the neck 28. When suitably energized, the yoke 38 causes the electron beams to scan the screen 30 in a rectangular raster.

Figure 2:
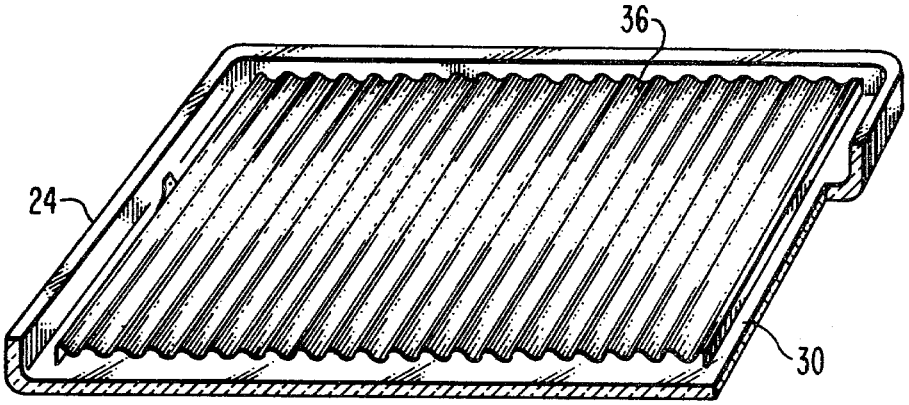
FIG. 2 is a perspective view of the mask-faceplate assembly of the tube of FIG. 1.

The apertured mask 36 further depicted in FIG. 2 is corrugated in a undulatory manner, e.g. sinusoidally, along the horizontal or major axis (in the direction of the longer dimension of the mask) with the corrugations extending vertically in the direction of the minor axis (between long sides of the mask or in the direction of the shorter dimension of the mask). It should be understood that the term corrugated is herein defined broadly to include various undulatory shapes including a sawtooth, sinusoidal, and other curved shapes. Although the mask 36 is shown without any curvature along its major and minor axes, a mask having curvatures along these axes also is included within the scope of the present invention. Similarly, while the faceplate panel is shown as flat, it too may be curved along both major and minor axes, and further, may have slightly curved sides.

The mask 36 includes a plurality of slit-shaped apertures aligned in vertical columns. In order to keep an acceptable line pattern on the screen, that is to maintain the desired brightness level and the spacing or nesting between the phosphor lines, aperture width and the horizontal spacing between aperture columns are generally varied as a function of the spacing between the mask 36 and the screen 30. The peak-to-peak wavelength dimension of the corrugated variation in the mask should be at least twice as great as the spacing between adjacent aperture columns.

Figure 3:
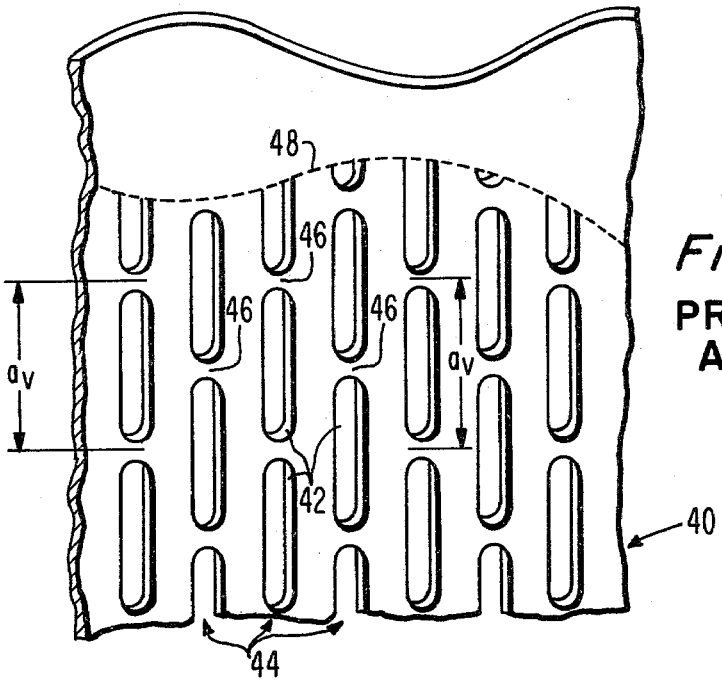
Fig. 3. PRIOR ART
FIG. 3 is a perspective view of a small portion of a prior art corrugated mask viewed from the gun side.

Detail of a prior art corrugated mask 40 is shown in FIG. 3. Slit apertures 42 are aligned in columns 44 with the slits in adjacent columns 44 being staggered relative each other. The mask sections vertically separating the slits 42 from each other within the columns 44 are the mask webs 46. The vertical distance from the center of one web 46 to the center of another within the same column 44, designated $a_v$, is the web repeat distance. In the prior art mask 40 of FIG. 3, this web repeat distance $a_v$ is constant over the mask 40. The web repeat distance $a_v$ in tubes having spherical masks is selected to reduce the formation of moire in such tubes. However, an optimized web repeat distance for spherical masks is inappropriate for a corrugated mask wherein an electron beam traces a scalloped line across the mask during scanning off the central horizontal axis. The upper extreme portion of the slit array which allows an electron beam to strike the screen in a straight line is shown by the dashed line 48.

Figure 4:
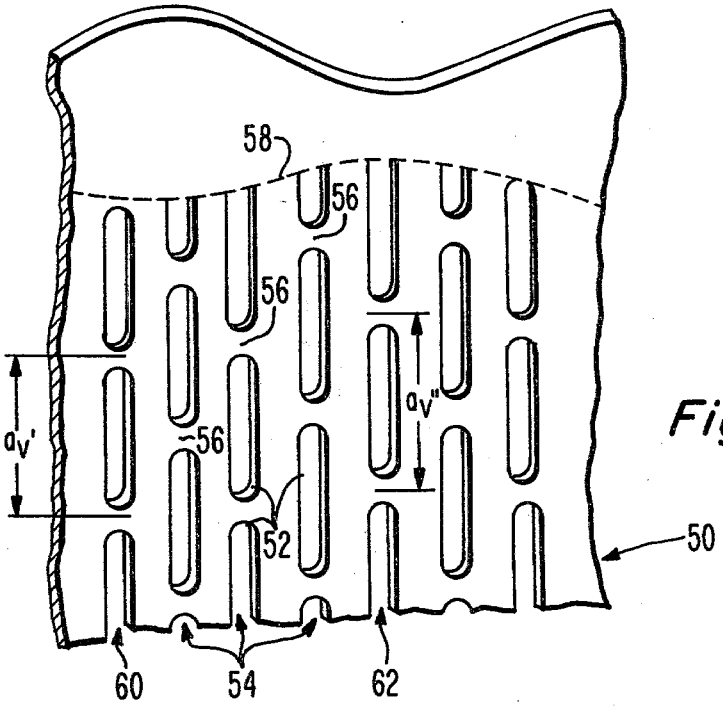
FIG. 4 is a perspective view of a small portion of an improved corrugated mask viewed from the gun side.

FIG. 4 shows an improved apertured mask 50. In this mask, apertures 52 are still aligned in columns 54 and apertures 52 within a column 54 are separated by webs 56. The upper electron beam intercept with the mask 50 is shown by dashed line 58. Unlike the prior art mask 40 of FIG. 3, the mask 50 of FIG. 4, has a varied web repeat distance from column-to-column across the mask 50. The web repeat distance for each column is proportional to the distance from the major axis of the mask to the mask intercept of any particular scan line. For example, column 60, which is located in a portion of the mask 50 which bows toward the electron guns and away from the screen, has a relatively short web repeat distance $a_v'$ whereas column 62, which is located in a portion of the mask 50 which bows away from the electron guns and toward the screen, has a relatively long web repeat distance $a_v''$. The web repeat distances are varied so that an electron beam scanning the corrugated mask 50 will have the same intercept pattern with the webs 56 as would occur in a conventional tube having a spherical mask with a uniform web repeat distance throughout the mask. Furthermore, because of variable web repeat distance, alternate columns will have the same number of webs between two scan lines.

Figure 5:
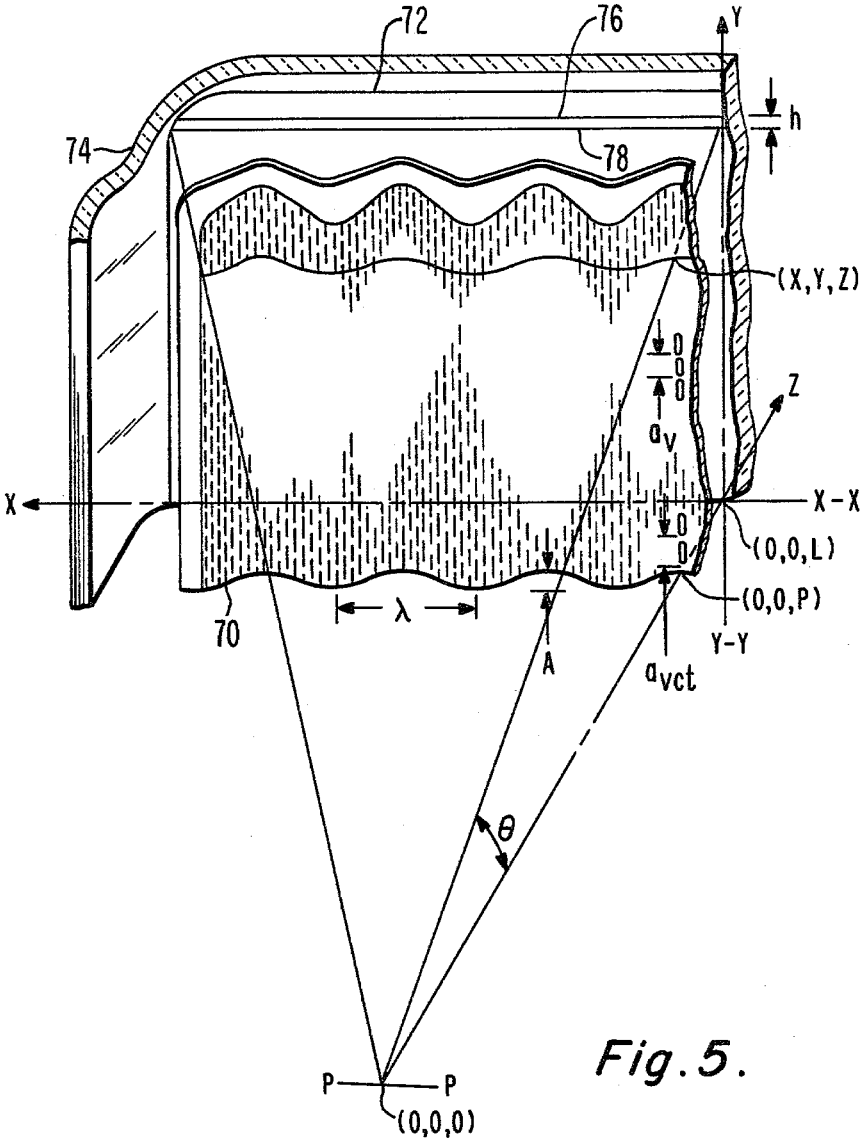
FIG. 5 is a partially cut-away perspective view of a quadrant of a color picture tube faceplate and mask assembly.

The equation for a substantially planar corrugated mask 70, shown in FIG. 5, where the corrugations are only a function of the displacement along the major axis X—X is, $$Z=P-(A/2)(1-\cos 2\pi(X/\lambda)$$

where:

Z is displacement in the direction of the tube central longitudinal axis Z—Z,

X is displacement along the major axis X—X,

P is the distance from the center of deflection P—P to the mask Z displacement center, A is the peak to peak amplitude of the corrugation, and λ is the wavelength or distance between two consecutive corrugations.

In FIG. 5, the mask 70 is shown in spaced relationship to a phosphor screen 72 located on an inner surface of a flat faceplate 74. Two consecutive scan lines 76 and 78 are shown at the top of the screen 72. These scan lines 76 and 78 have a center-to-center spacing at the screen equal to h. Referred back to the mask Z displacement center the scan separation $h_{mct}$ equals:

$$h_{mct} = \frac{P}{L} h$$

where L is the distance from the deflection center to the screen center. As used in the foregoing equation and as used hereinafter, the subscript "m" indicates at the mask and the subscripts "mct" and "ct" indicate at the mask center. The mask center for this purpose is the contour the mask would shrink to if the amplitude of the corrugations were reduced to zero.

In the past, it has been determined that certain ratios or $h_{mct}/a_v$ have yielded minimum observable moiré, where $a_v$ is the vertical web repeat distance between the webs. Once a ratio was selected, the value of $a_v$ obtained was held constant over the mask. This is not acceptable for a corrugated mask since it results in an objectionable herringbone moiré. Off center, the vertical web repeat distance must be varied to compensate for changes in mask scan intercept, therefore, the vertical web repeat distance $a_v$ must be, $$a_v = \frac{h_m}{h_{mct}} a_{vct}$$

For a corrugated mask, ignoring the shift in the deflection center, this approximately equals to:

$$a_v = \frac{Z}{P} \frac{\cos\theta}{\sin(\phi + \theta)} a_{vct}$$

where,

Z=f(x,y) is the function defining the mask contour at point (x,y,z)

θ is the vertical deflection angle defined as, $$\theta = \tan^{-1}\frac{y}{Z}, \text{ and } \phi = \cot^{-1}\frac{\partial f(x,y)}{\partial y}.$$

What is claimed is:

1. In a color picture tube having a corrugated mask wherein the mask corrugations are substantially parallel, said mask having slit shaped apertures aligned in columns parallel to the mask corrugations, the slits in each column being separated by web portions of the mask, said tube including an electron gun for generating a plurality of electron beams and means for scanning said beams in lines across the mask the improvement comprising the web repeat distance within a slit column being proportional to the distance from the major axis of the mask to the mask intercept of any particular scan line.

2. In a color picture tube having a corrugated mask wherein the mask corrugations are substantially parallel, said mask having slit shaped apertures aligned in columns parallel to the mask corrugations, the slits in each column being separated by web portions of the mask, said tube including an electron gun for generating a plurality of electron beams and means for scanning said beams in lines across the mask, the improvement comprising alternate slit columns including the same number of webs between two particular scan lines.

3. In a color picture tube having a corrugated mask wherein the mask corrugations are substantially parallel, said mask having slit shaped apertures aligned in columns parallel to the mask corrugations, the slits in each column being separated by web portions of the mask, said tube including a cathodoluminescent screen and an electron gun for generating and directing a plurality of electron beams through said mask to said screen, the improvement comprising the web repeat distance in corrugations of the mask that peak toward the electron gun being less than the web repeat distance in adjacent corrugations that peak toward the screen.

4. In a color picture tube having a corrugated mask wherein the mask corrugations are substantially parallel, said mask having slit shaped apertures aligned in columns parallel to the mask corrugations, the slits in each column being separated by web portions of the mask, said tube including an electron gun for generating a plurality of electron beams and means for scanning said beams in lines across the mask, the improvement comprising the ratios of the distance between the intercepts of two particular scan lines with a first aperture column to the distance between the intercepts of the same two scan lines with a second aperture column being equal to the ratio of the web repeat distance in the first column to the web repeat distance of the second column.

* * * * *